US005106090A

United States Patent [19]

Greenwood

[11] Patent Number: 5,106,090

[45] Date of Patent: Apr. 21, 1992

[54] APPARATUS AND METHOD FOR SELLING GAME TICKETS

[75] Inventor: W. Loren Greenwood, Woodinville, Wash.

[73] Assignee: Ace Novelty Co., Inc., Bellevue, Wash.

[21] Appl. No.: 626,028

[22] Filed: Dec. 12, 1990

[51] Int. Cl.[5] ..... A63B 71/00; B42D 1/00; B42D 15/00

[52] U.S. Cl. ..... 273/139; 283/52; 283/903; 283/901; 281/21.1; 281/27.3

[58] Field of Search ..... 273/139, 138 R; 283/51, 283/52, 53, 903, 901; 281/15.1, 21.1, 27.3

[56] References Cited

U.S. PATENT DOCUMENTS 483,715 10/1892 Fisher ..... 281/15.1
744,578 11/1903 Lough ..... 281/15.1
3,307,858 3/1967 Sanden ..... 273/139
4,943,090 7/1990 Fienberg ..... 273/139

FOREIGN PATENT DOCUMENTS 936633 9/1963 United Kingdom .

OTHER PUBLICATIONS

Douglas Press Inc. Brochure, "Banker's Club", 1987.

*Primary Examiner*—Benjamin Layno
*Attorney, Agent, or Firm*—Jones, Day, Reavis & Pogue

[57] ABSTRACT

A unitary device for selling tickets of chance that has a master ticket with visible data thereon and concealed indicia representing winning data. A plurality of chance tickets are pivotally joined to the master ticket such that any one of the chance tickets may be selected for purchase by pivoting with respect to each other and with respect to the master ticket. One of the chance tickets has concealed data matching the winning data concealed on the master ticket.

12 Claims, 1 Drawing Sheet

APPARATUS AND METHOD FOR SELLING GAME TICKETS

FIELD OF THE INVENTION

The present invention relates to gaming devices in general and in particular to a gaming device for selling tickets of chance in which a plurality of tickets of chance, each having concealed data thereon, are pivotally connected to a cover ticket having concealed indicia thereon representing winning data such that any one of the chance tickets may be selected for purchase by pivoting the chance tickets about the connection and removing at score line.

BACKGROUND OF THE INVENTION

Games of chance are becoming increasingly a part of industry and commerce. Such games of chance include specialty tickets of the paper type which have first and second sections, a first section of which identifies the ticket and a second section which contains a hidden combination of indicia representing winning and non-winning combinations. In one such type of ticket, the portion containing the concealed indicia comprises a plurality of folded panels on the inside of which is printed the combination of indicia. Once the panels are folded, a strip of thin colored paper is wrapped over the outside of the folded panels and the ends of the paper are glued together to hold the panels in the folded condition. When the purchaser desires to open the ticket, he simply tears the thin paper wrapping and opens the folds. In another type of specialty ticket, one or more combinations of indicia may be placed on a first card with a second card placed over and covering the surface of the first card. The two cards are attached in some manner such as by glue placed around the edges. Over each combination of indicia is a rectangular cover section in the second card that has perforated edges around at least three sides thereof which can be torn loose and the rectangular cover section lifted to view the indicia thereunder.

In another version, a predetermined number of chance tickets are sold, each of the chance tickets having concealed indicia thereon, and then a master ticket having concealed winning number thereon is opened to reveal the winning number and those holding the purchased tickets open their concealed numbers and at least one of the tickets will have winning indicia thereon corresponding to the winning indicia on the master ticket. With this system, the predetermined number of tickets are generally kept in a bowl or other container with the master ticket prominently displayed to attempt to persuade individuals to purchase one or more of the predetermined number of tickets. Because the state and other governmental entities regulate the sale of such tickets with detailed particularity, including tax stamps, serial numbers, dates of sale and the like, it is important that the master ticket which contains the information necessary to meet the governmental requirements be prominently displayed on the container holding the loose predetermined number of tickets. Clearly, it is difficult, with any particular type of container, to prominently display the master ticket.

The present invention fulfills a vacuum in the marketplace and overcomes the disadvantages of the prior art system of using a master ticket to sell a predetermined number of chance tickets one of which has winning indicia thereon that corresponds to the concealed winning indicia on the master ticket. With the present invention, a unitary gaming device is provided that has the master ticket as a cover display with all of the governmental required indicia visible thereon as well as concealed indicia representing winning data, and a plurality of chance tickets, each of the tickets having at least one concealed number thereon that matches the concealed winning data on the master ticket. The chance tickets and the master ticket are stacked in superimposed relationship with the master ticket on top. An orifice is formed in the ends of each of the chance tickets and the master ticket and a pivoting device such as a bolt or other connecting means couples the chance tickets and the master ticket together such that any one of the chance tickets may be selected for purchase by pivoting the chance tickets about the pivot point or bolt and removing at the score line. In this manner, the tickets are all kept together with the master ticket until sold. In addition, the master ticket clearly displays the governmental required indicia and is never separated from the plurality of chance tickets pending the sale of the chance tickets.

Thus, it is an object of the present invention to provide a gaming device for selling tickets to purchasers that maintains a master ticket and the chance tickets in a unitary assembly for merchandising with the master ticket displaying the governmental required indicia.

It is also an object of the present invention to provide a unitary gaming device for selling tickets to purchasers that is constructed such that any one of a plurality of chance tickets may be selected by a purchaser by rotating the chance tickets about a pivot point joining all of the chance tickets and a master ticket.

SUMMARY OF THE INVENTION

Thus, the present invention relates a device for use in selling tickets of chance comprising a master ticket having visible data displayed thereon, concealed indicia on the master ticket representing winning data, a plurality of chance tickets, each of the chance tickets having concealed data thereon, one of the chance tickets having concealed data matching the winning data concealed on the master ticket, and a bolt or other attachment for pivotally joining the plurality of chance tickets and the master ticket such that the visible data on the master ticket is displayed and any one of the chance tickets may be selected for purchase by pivoting the chance tickets about the bolt or other attachment device.

The invention also relates to a method of preparing gaming tickets for sale to purchasers comprising the steps of stacking a plurality of chance tickets in superimposed relationship, each of the tickets having concealed data thereon, placing a master ticket on top of the stack of tickets, the master ticket having indicia thereon and concealed winning data corresponding to the concealed data on at least one of the chance tickets, and pivotally attaching the master ticket and the stacked chance tickets to each other such that any one of the chance tickets may be selected by a purchaser by rotating the tickets with respect to each other.

BRIEF DESCRIPTION OF THE DRAWINGS

These and other objects of the present invention will be more fully understood in conjunction with the accompanying drawings in which like numbers indicate like components and in which.

DETAILED DESCRIPTION OF THE DRAWINGS

Figure 1:
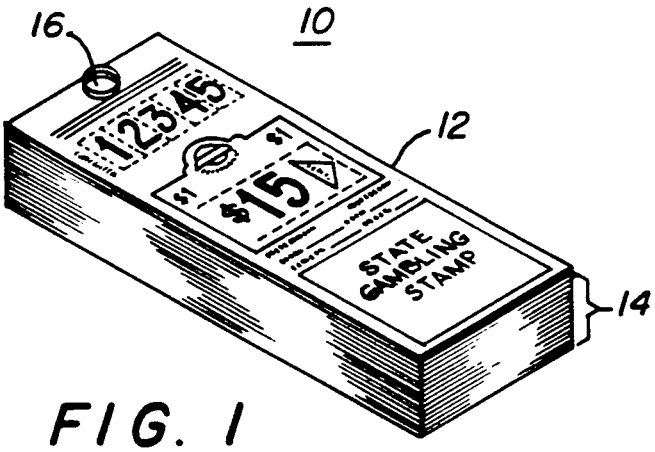
FIG. 1 is a perspective view of the stacked chance tickets with the master ticket on the top thereof and an attachment device holding them together in superimposed relationship.

FIG. 1 illustrates how the present invention maintains the chance tickets and the master ticket as a unitary device that allows any one of the plurality of chance tickets to be selected by a purchaser by rotating the chance tickets about a pivot point and removing at the score line. As can be seen in FIG. 1, the device 10 has a master ticket 12 and a plurality of chance tickets 14 in superimposed relationship. Thus, as can be seen, each ticket 14 lies in a different plane, each plane being parallel to one another. A pivoting device 16 is coupled through one end of the stack of chance tickets and the master ticket to hold the chance tickets and the master ticket in superimposed relationship but movable rotatably with respect to each other. Thus, a ticket 14 may be viewed and selected for purchase by swiveling the tickets along their respective planes about the pivotal means 16 as shown in FIG. 2.

Figure 2:
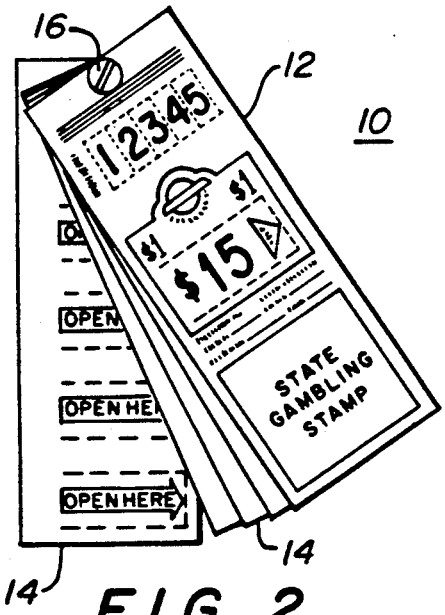
FIG. 2 is a view of the stack of tickets in a partially fanned out relationship illustrating how any one of the chance tickets may be selected by a purchaser by rotating the tickets with respect to each other about a pivot point.
Figure 3:
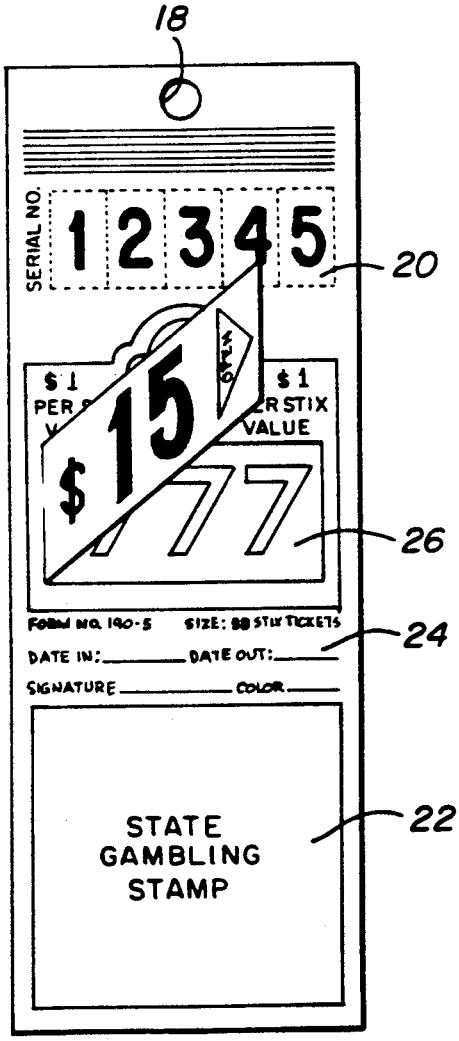
FIG. 3 is a detailed top view of the master ticket.

FIG. 2 illustrates the manner in which the tickets may be rotated about the pivot point 16 in such a way that any one of the plurality of chance tickets 14 may be selected by a purchaser. The fastening device 16 may be a bolt or other attachment device that extends through an orifice through one end of each of the tickets 14 and the master ticket 12. As will be seen with respect to FIGS. 3 and 4, an orifice 18 is formed in one end of the master ticket 12 and one end of each of the chance tickets 14 so that a fastening device 16 such as, for example only, a plastic bolt may be inserted through the orifices 18 and a nut used to secure the master ticket 12 and all of the chance tickets 14 in pivotal superimposed relationship with each other as a unitary package.

Figure 4:
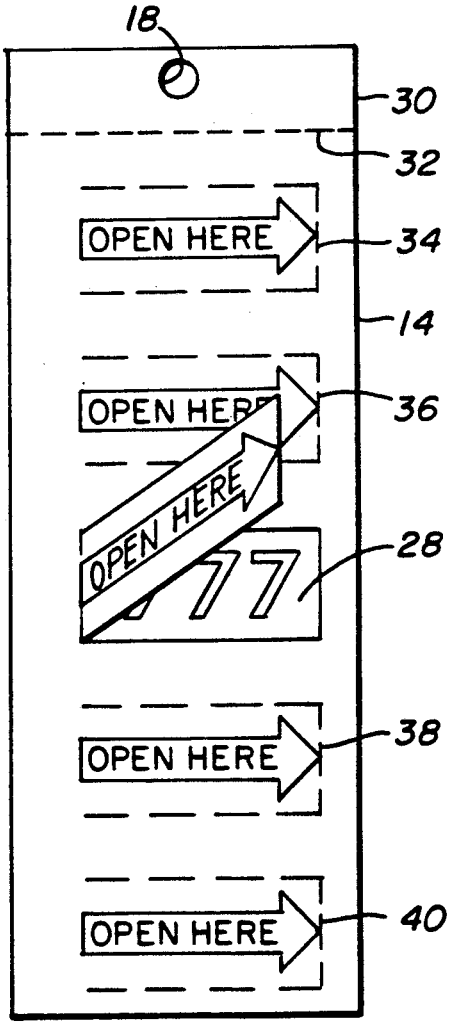
FIG. 4 is a detailed top view of one of the chance tickets.

It is important that the chance tickets and the master ticket be maintained as a unitary device because the various governmental laws have certain requirements and restrictions with respect to the sale of such chance tickets until sold. They require, for instance, a serial number 20, a tax stamp 22, and lines 24 on which dates can be entered on which the tickets were sold or the device displayed. Other governmental regulations may require various other indicia displayed with respect to the sale of the chance tickets. The master ticket 12 includes concealed indicia 26 representing winning data. As can be seen in FIG. 4, one of the chance tickets 14 also has concealed data 28 thereon that matches the winning data 26 concealed on the master ticket 12. It will be noted in FIG. 4 that each chance ticket 14 is coupled to a stub portion 30 by a perforation line 32. This enables the chance ticket 14 to be easily removed from stub 30 upon purchase thereof by tearing along perforations 32. It will also be noted that the chance ticket 14 in FIG. 4 has a plurality of concealed indicia in areas 34, 36, 38 and 40 in addition to the concealed indicia 28. Thus, in the example shown, the purchaser of one of the chance tickets 14 has five opportunities to have the indicia identical to the winning indicia 26 on the master ticket 12. Clearly, more or less opportunities for winning could be provided on each ticket.

The fastening device 16, as indicated earlier, is shown as a plastic bolt with a nut on one end, but, of course, may be of any desired type of fastening device so long as it enables the tickets to rotate with respect to each other and with respect to the master ticket.

Thus, there has been disclosed a novel gaming device for selling tickets of chance to purchasers. It is a unitary device that includes a master ticket as a cover sheet having thereon all of the indicia necessary for governmental approval to sell the tickets of chance. The master ticket also has hidden indicia thereon representing the winning data. All of the chance tickets are hingedly connected to the master ticket with a fastening device in superimposed relationship with each other such that the tickets may be rotated about the fastening device so that any one of the plurality of chance tickets may be selected by a purchaser simply by rotating or swiveling the chance tickets along their respective plane about the hinge or pivot point and removing the ticket at the score line. Simultaneously, the purchaser can see the master ticket and know that the concealed indicia have not already been opened or otherwise tampered with.

While the invention has been shown and described with respect to a particular embodiment thereof, this is for the purpose of illustration rather than limitation; other variations and modifications of the specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

I claim:

1. A unitary device for selling tickets of chance comprising:

a master ticket having visible data thereon;

concealed indicia on said master ticket representing winning data;

a plurality of chance tickets, each of said chance tickets having concealed data thereon, one of said chance tickets having concealed data matching the winning data concealed on said master ticket; and means for pivotally attaching said plurality of chance tickets to said master ticket such that said visible data on said master ticket is displayed and each ticket lies on a different plane, each plane being parallel to one another and any one of said chance tickets being viewed and selected for purchase by swiveling said chance tickets along their respective planes about said pivotal attaching means.

2. A device as in claim 1 wherein each of said plurality of chance tickets has multiple areas with concealed data in each of said areas.

3. A device as in claim 2 further comprising:

a stub portion removably attached to one end of each of said plurality of chance tickets for enabling each chance ticket to be removed for sale; and an attachment device extending through one end of said master ticket and each chance ticket stub portion for pivotally joining said plurality of chance tickets to said master ticket.

4. A device as in claim 3 wherein perforations join each of said plurality of tickets to its corresponding stub for easy removal of said tickets as they are purchased.

5. A device as in claim 4 wherein said plurality of chance tickets and said master ticket are of substantially identical size and are pivotally attached to each other in superimposed relationship.

6. A device as in claim 5 further comprising:

an orifice in each of said plurality of chance ticket stubs and said one end of said master ticket; and a fastener extending through said orifices as said attachment device to secure all of said chance tickets and said master ticket in superimposed relationship and to allow any one of said chance tickets to swivel with respect to said master ticket and to the other chance tickets to enable selection thereof by a purchaser.

7. A device as in claim 6 wherein said fastener is a plastic bolt for securing said tickets and said master ticket.

8. A method of preparing tickets of chance for sale to purchasers comprising the steps of:

stacking a plurality of chance tickets in superimposed relationship, each of said tickets having concealed data thereon;

placing a master ticket on top of said stack of tickets, said master ticket having visible indicia thereon and concealed winning data corresponding to the concealed data on at least one of said chance tickets; and pivotally attaching said master ticket and said stacked chance tickets to each other such that each ticket lies on a different plane, each plane being parallel to one another and anyone of the chance tickets being viewed and selected for purchase by swiveling the chance tickets with respect to each other about the pivotal attachment.

9. A method as in claim 8 wherein the step of pivotally attaching said master ticket and said stacked chance tickets further comprises the steps of:

forming each of said chance tickets with a removable stub at one end; and extending an attachment device through one end of said master ticket and each chance ticket stub to enable pivotal movement of said chance tickets with respect to said master ticket and to each other.

10. A method as in claim 9 further comprising the step of joining each of said removable stubs to a corresponding one of said chance tickets with a line of perforations that enables each of said tickets to be torn from its associated stub upon purchase thereof.

11. A method as in claim 10 wherein the step of extending an attachment device through said master ticket and said chance tickets further comprises the steps of:

forming an orifice in the stub of each of said chance tickets and in one end of said master ticket; and extending a fastener through said orifices to secure said tickets and said master ticket in superimposed relationship and to allow any one of said tickets to swivel with respect to said master ticket and with respect to the other chance tickets to enable selection thereof by a purchaser.

12. A gaming device for selling tickets of chance to purchasers comprising:

a plurality of chance tickets, each of said tickets having at least one concealed number thereon;

a master ticket;

governmental required indicia on said master ticket;

a concealed winning number on said master ticket matching at least one of said concealed numbers on said plurality of chance tickets; and means for pivotally attaching said master ticket to said plurality of chance tickets such that said governmental required indicia are visible, and such that each ticket lies on a different plane, each plane being parallel to one another and any one of said plurality of chance tickets being viewed and selected for purchase by swiveling said chance tickets along their respective plane about said pivotal attaching means.

* * * * *